US005592978A

United States Patent [19]

Garcia et al.

[11] Patent Number: 5,592,978

[45] Date of Patent: Jan. 14, 1997

[54] SYSTEM FOR CONTROLLING A CHAIN LINK FENCE WEAVING MACHINE

[75] Inventors: Jose G. Garcia, La Puente; LD Malatka, Huntington Beach, both of Calif.

[73] Assignee: BMCI, Inc., South El Monte, Calif.

[21] Appl. No.: 412,457

[22] Filed: Mar. 29, 1995

[51] Int. Cl.[6] ..... B21F 27/04

[52] U.S. Cl. ..... 140/92.94; 140/92.6

[58] Field of Search ..... 140/92.3, 92.4, 140/92.6, 92.8, 92.94

[56] References Cited

U.S. PATENT DOCUMENTS

| | | | |
|---|---|---|---|
| 991,542 | 5/1911 | Roehrich | 140/92.8 |
| 1,005,480 | 10/1911 | Schmid . | |
| 3,601,163 | 8/1971 | Ellis | 140/92.94 |
| 4,572,249 | 2/1986 | Lange | 140/92.6 |

*Primary Examiner*—Lowell A. Larson
*Attorney, Agent, or Firm*—James G. O'Neill

[57] ABSTRACT

An improved system for operating a chain link fence weaving machine. The system includes an electronic motor coupled to a main spindle shaft of the weaving machine. A trough is disposed adjacent to a weaving blade attached to the main spindle and coupled to the weaving machine. The trough receives two intercoiled needles (picket) from the weaving blade for weaving the fence. The trough has first and second opposing portions positioned to receive the picket therebetween. A retaining slot extends between the first and second portions. The radius of the first portion of the trough is less than the radius of the second portion thereof to prevent the two intercoiled needles being woven in the trough from extending into the slot. An actuation mechanism opens and closes the retaining slot to frictionally engage or release a portion of the fence held in the slot. A control system is coupled to the motor for controlling the fabrication rate of fence being woven. The control system also controls the height and length of the fence being fabricated by the weaving machine.

20 Claims, 3 Drawing Sheets

SYSTEM FOR CONTROLLING A CHAIN LINK FENCE WEAVING MACHINE

BACKGROUND OF THEINVENTION

1. Field of the Invention

This invention relates generally to systems for controlling the weaving of chain link fence, and more particularly, to an improved and simplified system for controlling a chain link fence weaving machine and for weaving the fence.

2. Description of Related Art

Chain link fence weaving machines are well known in the art. One example of a single wire prior art chain link weaving machine, is shown in U.S. Pat. No. 1,005,480 to Schmid. This patent discloses a machine having a knife or weaving blade which bent a single strand of wire into a zigzag configuration now referred to as a "needle". The needle is passed through a feed into a spiral gripper or plaiting tube where the single needle is woven to a fence portion held in the spiral gripper. The plaiting tube and/or spiral gripper is now referred to in the art as a "trough". Many improvements have been made in chain link fence weaving machines since the issuance of the Schmid patent, however the trough still remained tubular. For example, a more recent improvement in chain link fence weaving machines is the 2MT-VS, variable drive automatic fence weaving machine manufactured and sold by BMCI, Inc., doing business as Bergandi Machinery Company of South El Monte, Calif. The Bergandi machine is commonly referred to as an automatic two (2) wire type, wherein two strands of wire from two large coils of wire are continuously fed onto a forming mechanism (weaving blade), so that two needles at a time are formed into a picket in an intercoiled manner and then woven by a trough weaving mechanism to form continuous lengths of chain link. An example of such 2 wire weaving machines is disclosed in U.S. Pat. No. 4,566,501 to Rohrbacher.

In the 2 wire prior art machines a main spindle shaft drives a weaving blade that coils the 2 strands of wire to form a picket. The main spindle shaft and attached weaving blade must be repeatedly stopped and started at precise intervals to allow for picket cutting, indexing and selvage, and the subsequent weaving of the picket into the formed fence. In addition to stopping at a precise point, the main spindle shaft must be prevented from counter-rotating, when the picket on the weaving blade attempts to straighten itself out. Additionally, when the 2 intercoiled needles are cut on 2 wire machines, such as the Bergandi machine, the cutting mechanism forms a hook, referred to as the "starting hook" on the cut off end of one of the needles. The needle having the starting hook formed thereon is referred to as the "leading needle or wire", and is the needle that is actually woven to the previously woven fence in the trough. The second needle is referred to as the trailing needle, and as described above, is intercoiled with the leading needle to form a picket.

The required starting, stopping and indexing of the main spindle shaft of prior art machines, such as the Schmid and Bergandi weaving machines mentioned above, are normally controlled with mechanical or electro-mechanical clutch-brake type mechanisms. These mechanisms are typically coupled between the main spindle shaft and a main motor or prime mover of the weaving machine. The clutch-brake mechanism is usually activated by a signal received from a control mechanism, which in present day machines may be a digital counter. After an activation signal is received by the mechanism, the motor is disconnected from the system through the clutch and the main spindle shaft is stopped and held by the brake device. Such clutch-brake mechanisms take many well known configurations, such as friction clutch-hydraulic brake devices with positive stop, oil shear devices, and electro-mechanical devices.

A disadvantage of the known clutch-brake devices, is that the motor continues to operate at a fixed speed, while it is disconnected from the system, since it is mechanically disconnected by the clutch. The output rate of the known weaving machines are controlled by the speed of the spindle, approximately 600 RPM, and such weaving machines are limited to the clutch-brake mechanism's ability to control the torque that the motor is generating at the fixed speed. Therefore, the output rate of such weaving machines is limited. A further disadvantage of clutch-brake mechanisms, is that when they are engaged to start weaving further pickets to a fence, a "fast start" occurs when the motor operating at its fixed speed is engaged. When the motor is so engaged, depending on the gauge of the wire and the speed of the motor, the inertia of the wire wrapped around the weaving blade may cause the weaving blade to deform or abrade the wire and/or, may also bend the starting hook, causing it to misweave. In addition to abrading the wire and bending the starting hook, this fast start causes stress to the weaving blade. These abrading and bending problems are a particularly serious problem if higher speeds are attempted, when using lighter gauge wires, and/or when weaving PVC coated wires. A still further disadvantage of known clutch-brake systems, is that they do not stop the main spindle shaft at precise intervals, so that indexing for the weaving of the next picket to be woven is somewhat inefficient. Another disadvantage of clutch-brake mechanisms, is that they may fail over time, due to wear, for example.

A further disadvantage of the prior art has recently been discovered when control means, such as disclosed herein, allowed increased production rates of chain link weaving machines. At such increased production rates, the starting hook of the leading needle, which is being rotated in the known troughs, tend to catch in the holding slot of the troughs, since the starting hook is spiraling through the trough at higher speeds. When a starting hook catches in the slot, it deflects and causes a misweave of the fence. Additionally, at higher weaving speeds, the starting hook of the leading needle may flex, so as to not initially enter a previously woven picket, thereby causing a misweave.

There is, therefore, a need for an improved and simplified chain link fence weaving machine that will operate at increased speed, and which includes a system for controlling the increased production rate, while at the same time preventing misweaves by such a machine.

SUMMARY OF THE INVENTION

It is therefore an object of the present invention to provide an improved and simplified system for operating a chain link fence weaving machine.

It is another object of the present invention to provide an improved and simplified system for operating a chain link fence weaving machine that has an increased production rate.

It is a further object of the present invention to provide an improved system for operating a chain link fence weaving machine where the motor is directly connected to the main spindle for increasing the operating efficiency of the machine and for allowing the machine to be ramped up to prevent misweaves.

It is a still a further object of the present invention to provide an improved system for operating a chain link fence weaving machine having a motor which drives the weaving blade at a speed approximately twice the speed of weaving blades used in the prior art.

It is an additional object of the present invention to provide an improved operating system and weaving trough in a chain link weaving machine.

And, it is yet another object of the present invention to provide an improved elliptical trough for use with an improved operating system.

These and other objects and advantages of the present invention are achieved by providing an improved and simplified system for operating a chain link fence weaving machine. The system includes an electronic motor coupled to a main spindle shaft of the machine for driving the main spindle shaft and an attached weaving blade. The motor comprises an AC induction type motor that has a top speed sufficient to drive a weaving blade at approximately 1200 RPM, which is approximately twice the output speed of weaving blades used in the prior art. An electronic control system is coupled to the motor, through an inverter means, for controlling the motor.

The electronic control system controls the motor's speed for controlling the rate that the weaving blade feeds pickets into a trough to determine the fabrication rate of chain link fence being woven. The speed of the motor is variable, so as to drive the weaving blade up to the maximum speed, to accommodate different weaving variables such as wire diameter, tensile strength, mesh width, and weaving width. Therefore, the machine can produce fence at a maximum rate of twice the output rate found in the prior art.

The control system also controls the height and length of the fence being fabricated by the machine. The control system includes input means for entering data, computing means coupled to the input means for processing the data received, and an invertor means coupled to the computing means and to the motor. The computing means processes such data as, the number of diamonds per picket to determine, together with other variables, the height of the fence, the number of pickets per roll to determine the length of a roll, and totals the number of rolls produced by the machine during a measured time interval. The computing means can also save programs for future use.

The inverter means receives signals from the computing means, processes the signals, then transmits signals to the motor for controlling the motor as if the motor were a DC device. The speed of the motor determines the rate that the weaving blade feeds pickets into the trough. The inverter means also transmits signals to the motor for controlling fence height and length, responsive to signals received from the computing means.

The improved trough is located adjacent to the weaving blade and is coupled to the weaving machine. The trough receives intercoiled pickets from the weaving blade for weaving the fence. The trough has first and second opposing portions positioned for receiving and weaving the intercoiled pickets therebetween. A slot extends between the first and second portions. The radius of the first portion prevents the starting hook of the leading needle of the picket being fed through the trough from extending into the slot. The first portion of the trough is provided with a retaining means for retaining a portion of the formed fence therein substantially perpendicular to the trough, when the portion is engaged in the slot.

An actuation mechanism is provided for opening and closing the retaining means. The actuation mechanism closes the slot to frictionally engage a trailing portion of a just woven picket in the retaining slot, while a further picket is being woven thereto in the trough. The actuation mechanism opens the retaining slot to release the formed fence after a further picket is woven to it. The weaving machine indexes the formed fence, and thus lifts the picket that has just been woven to the fence out of the retaining means, so that a trailing portion of a just woven picket is positioned and held in the retaining means, and another picket woven thereto, to fabricate the fence.

BRIEF DESCRIPTION OF THE DRAWINGS

The objects and features of the present invention, which are believed to be novel, are set forth with particularity in the appended claims. The present invention, both as to its organization and manner of operation, together with further objects and advantages may best be understood by reference to the following description, taken in connection with the accompanying drawings, in which:

DESCRIPTION OF THE PREFERRED EMBODIMENTS

The following description is provided to enable any person skilled in the art to make and use the invention and sets forth the best modes contemplated by the inventors of carrying out their invention. Various modifications, however, will remain readily apparent to those skilled in the art, since the generic principles of the present invention have been defined herein specifically to provide for an improved and simplified system for controlling and operating a chain link fence weaving machine, generally indicated at 10.

Figure 1:
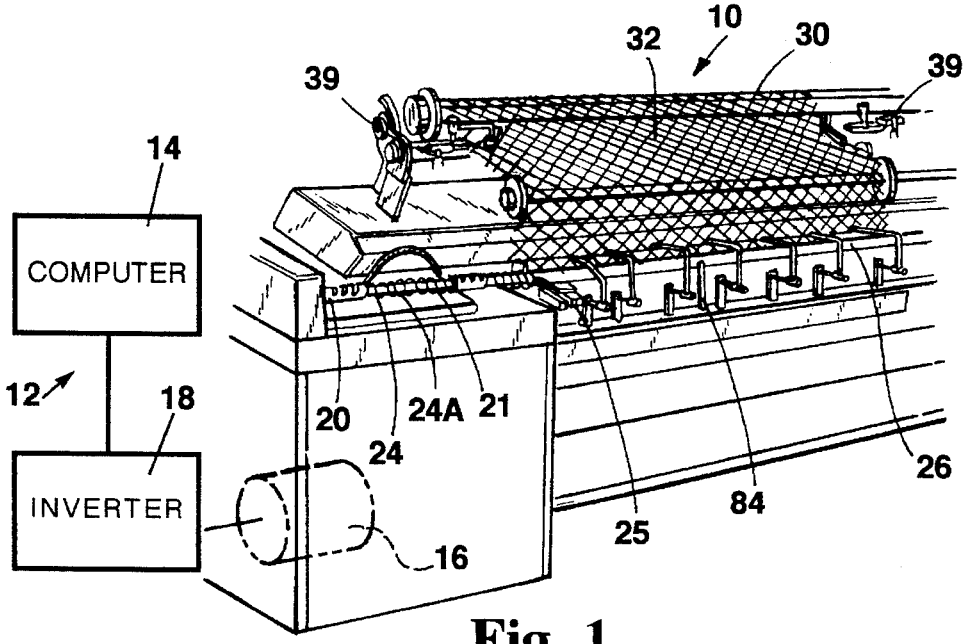
FIG. 1 is a perspective, schematic view showing a chain link fence weaving machine embodying the novel features of the present invention.
Figure 2:
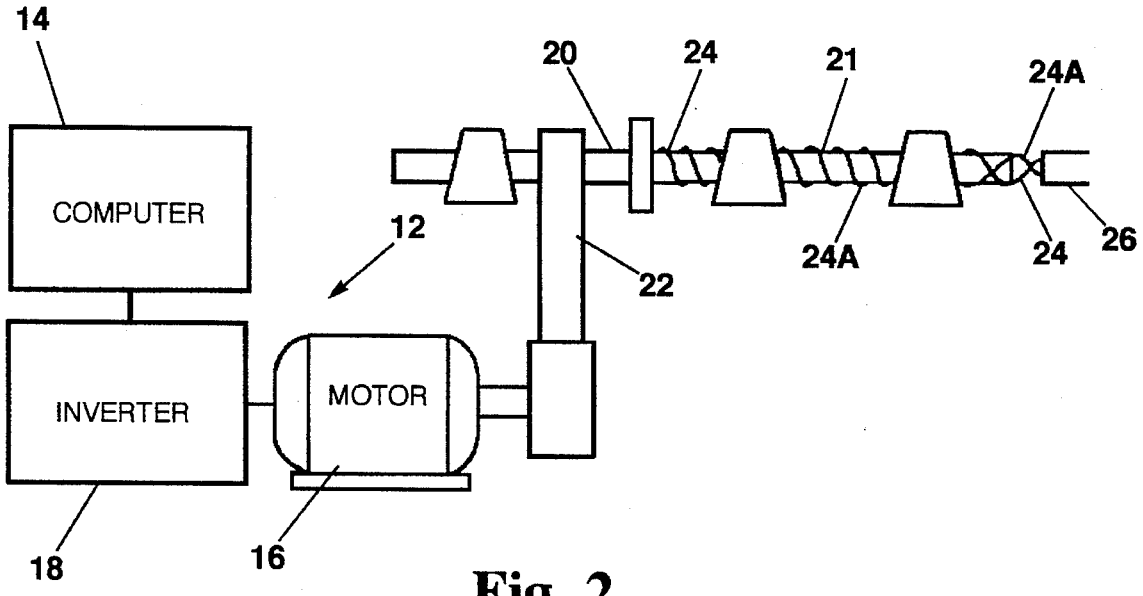
FIG. 2 is a schematic representation of the novel control system of the present invention.

Referring now to FIGS. 1 and 2 of the drawings, there shown is a schematic representation of the chain link fence weaving machine 10 having a control system 12 that is coupled to the machine 10 for controlling and operating the machine 10. The control system 12 includes a computing means 14 that is coupled to an electronic motor 16, through an inverter 18. The motor 16 may comprise any suitable electronic motor, such as an AC induction motor, that has an adjustable speed range capable of driving a weaving blade at up to approximately 1200 RPM. The inverter 18 causes the motor 16 to function as if the motor were a DC device.

The motor 16 is connected to a main spindle shaft 20 of the machine 10, via a driving means 22, such as a belt, for driving the main spindle shaft. The main spindle shaft, is in turn mechanically coupled to a weaving blade 21. As the motor 16 drives the main spindle shaft 20 and weaving blade 21, wires 24 and 24A, from 2 separate spools of wire (not shown) are fed to the weaving blade 21. The weaving blade 21 forms and intercoils the wires 24, 24A in a known manner to form 2 needles, and helically feeds these needles, also called a "picket", into an improved elongated trough 26

(more thoroughly discussed below) where they are cut-off after being woven to a fence 30.

Two intercoiled needles 24 and 24A are woven to the fence after being formed by lengths of the wires 24, 24A on weaving blade 21. The weaving blade then feeds the picket into the trough 26 where the picket is woven to the fence 30. After the picket is woven to the fence 30, it is cut-off by using cutting means 25, in a manner well known to those skilled in the art, so as to leave the end of the leading needle 24 with a starting hook 28 thereon. Therefore, when being woven to the fence, the leading needle 24 and intercoiled trailing needle 24A are both woven to the fence. However, because only the leading edge of the leading needle 24 is provided with the starting hook 28, only the starting hook 28 and the leading needle 24 are actually woven to a prior formed trailing needle 24A. After being woven, each pair of just woven needles 24, 24A are lifted out of the trough 26, through a retaining means or slot 66 (shown in FIGS. 5A and 5B). The trailing needle 24A, intercoiled with the just woven needle 24 is then partially retained in the slot 66', so that a further pair of intercoiled needles (picket) 24, 24A can be woven thereto. This process is repeated until the desired length of fence 30 is achieved.

Figure 3:
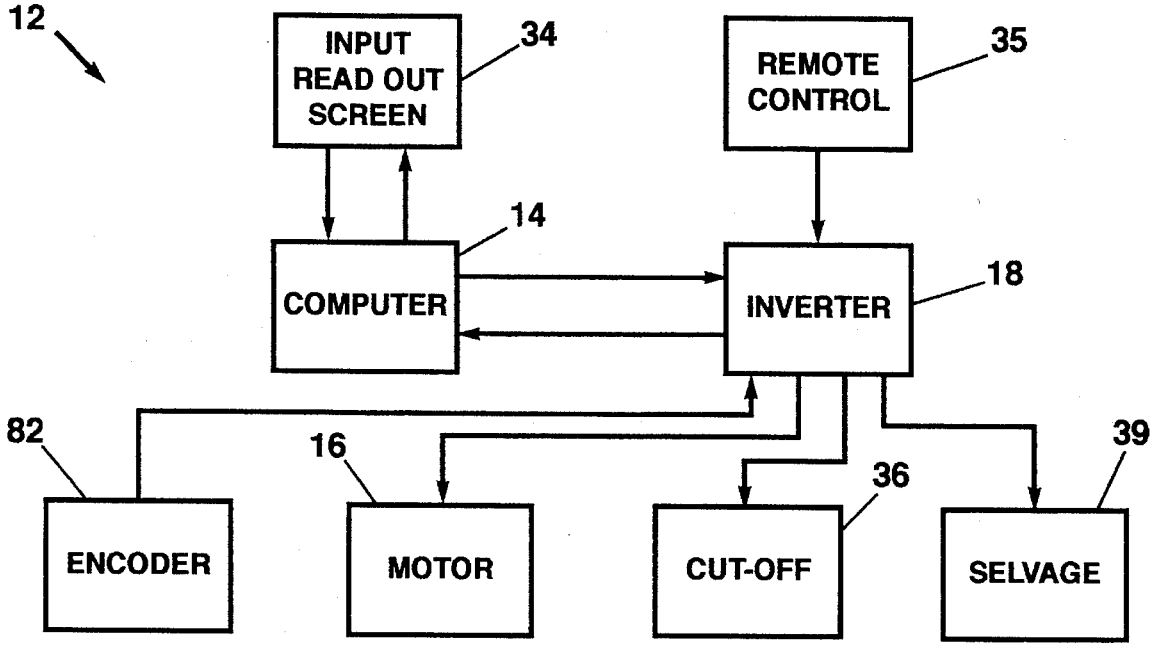
FIG. 3 is a block diagram showing the electronic components of the preferred embodiment of the control system.

Referring now to FIG. 3 of the drawings, there shown is a block diagram of a presently preferred control system 12 of the present invention. The control system 12 includes an input means 34, such as touch screen, coupled to the computing means 14. Desired data is input into the computer 14 through the input means 34 for controlling the inverter 18. The computer 14 may comprise any computer that is known in the art, and which is capable of performing the functions necessitated by the present invention.

The inverter 18 processes signals received from the computer 14, using well known methods, such as pulse width modulation for example, and transmits the desired signal to a desired source, such as the motor 16. The inverter 18 also transmits a signal to the cutting means 25 for cutting needles 24, 24A and to form the starting hook 28 on the leading needle, at the appropriate time. The inverter 18 can further transmit a signal to a knuckling mechanism 39, to perform selvage (also shown in FIG. 1), if it is desired to knuckle over or twist cut ends of the formed fence, in a manner well known to those skilled in the art.

A remote terminal 35 may be connected to the inverter 18, if it is desired to operate the machine 10 from a remote location. The remote terminal 35 is connected to the inverter 18 using well known methods.

Figure 4:
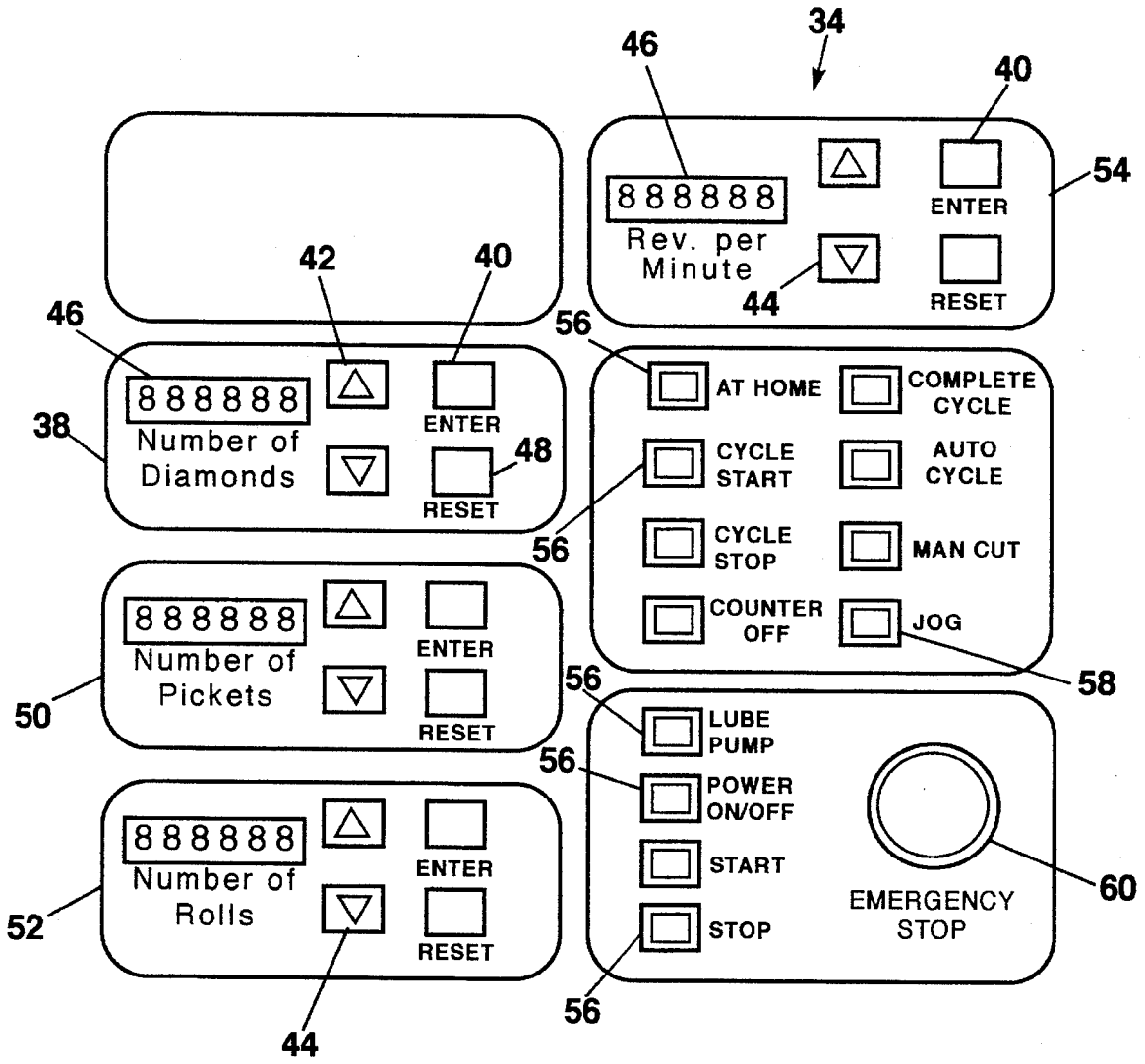
FIG. 4 is a schematic representation of an input device for the preferred embodiment of the control system.

Referring now to FIG. 4 of the drawings, there shown is a schematic representation of an embodiment of the input means 34 of the present invention, used to input data into the computer 14, for controlling a number of variables when weaving the fence 30. The input means 34 and computer 14 may comprise an integrally formed unit, for example. In the embodiment shown, the input means 34 includes a number of panels, or similar type areas on a touch screen, for entering the desired data.

A first area or panel 38 is provided for controlling the number of diamonds or links 32 along the width of the formed fence (formed by linked needles 24, 24A). The desired count of diamonds 32 is selected by depressing an ENTER area or button 44 until the desired count is shown on a display 46. The display 46 may be any suitable display, such as an LED (light emitting diode), or LCD (liquid crystal display), or a portion of a touch screen. After the desired count is shown in the display 46, the ENTER area or button 40 is depressed to store the desired count. The count is reset to zero, by depressing a RESET area or button 48.

Further areas or panels are provided for changing picket count 50 and roll count 52. The picket count area or panel 50 is provided for determining the length of the fence 30 being produced, while the roll count area or panel 52 keeps count of the number of rolls being produced over a predetermined time period. The areas or panels 50, 52 are operated as discussed with respect to the diamond count area or panel 38.

An RPM area or panel 54 is provided for adjusting the speed of the motor 16 and displays the speed of the main spindle shaft 20. The speed of the main spindle shaft 20 can be adjusted while the motor 16 is driving the main spindle shaft 20, by first pressing the ENTER area or button 40, then pressing either the UP 42 or DOWN 44 area or button, until the desired RPM is shown in the display 46. In this manner, the motor may be used to ramp the weaving machine up so as to prevent any unneeded flexure of the starting hook end and abrading of the needles on the weaving blade. Once the desired RPM is shown, the ENTER area or button 40 is depressed, to set the new speed. The speed of the motor is variable up to a maximum which must be sufficient to drive the main spindle shaft and, therefore, the weaving blade 21, at approximately 1200 RPM.

The input means 34 is further provided with a number of areas or switches 56 that preform various functions. Most notably, a JOG area or switch 58 is provided. The JOG area or switch 58 enables an operator to rotate the main spindle shaft 20 in small increments at low speeds. This feature enables precise positioning of formed needles 24, 24A coming off of the weaving blade 21. Other areas or switches 56 provided may include POWER ON/OFF for energizing the input means 34, START and STOP for controlling the machine 10 and AT HOME for returning the spindle 20 to an initial position. An EMERGENCY STOP area or switch 60 is provided to simultaneously shut down the machine 10 and input means 34, in case of an emergency. Other areas or switches 56 may be provided to suit the user's needs.

Figure 5A:
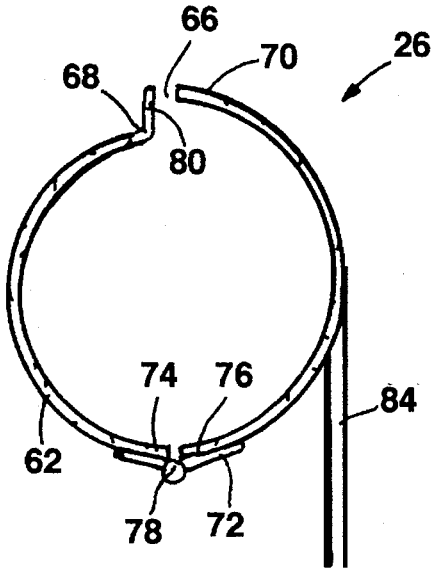
FIGS. 5A and 5B are cross sectional views showing the novel elongated trough of the preferred embodiment of the present invention.
Figure 5B:
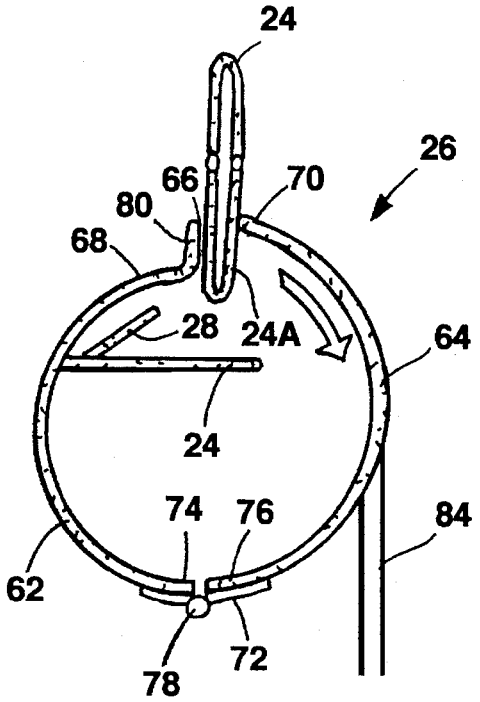

Referring now to FIGS. 5A and 5B of the drawings, there shown is the improved weaving means or trough 26 of the preferred embodiment of the present invention. The trough 26 is generally elliptical in cross-section and comprises a first arcuate portion 62 and a second arcuate 64 portion. A slot 66 extends between a first end 68, 70 of each of the portions 62, 64. A hinge member 72 is provided to couple a second end 74 of the first portion 62 to a second end 76 of the second portion 64. The hinge member 72 includes spring means 78 for biasing the first ends 68, 70 of the portions 62, 64 towards one another. The radius of the first portion 62 is less than the radius of the second portion 64 to prevent the intercoiled needles 24, 24A, and in particular the starting hook 28, being woven in the trough 26 (only one needle, the leading needle 24, together with its starting hook 28 may be seen in FIG. 5B), from catching in or extending into the slot 66.

The first portion 62 is further provided with an upwardly projecting flange 80 at the first end 68 thereof. The flange 80 extends substantially parallel to the first end 70 of the second portion 64. The flange 80 retains a portion of a trailing needle 24A of the woven fence 30, held or retained in the slot 66, substantially perpendicular to the trough 26, to aid in weaving.

Referring again to FIG. 3 of the drawings, in use, the desired parameters are input into the computer 14 using the input means 34, for designing the fence 30 to be produced. The JOG area or button 58 may be pressed for precise positioning of the main spindle shaft 20. The inverter 18 receives signals from the computer 14, processes the signals, then signals to motor 16 to begin driving the main spindle shaft 20 and weaving blade 21.

An encoder 82 may be provided to receive feed-back information from the motor 16, in a manner well known to those skilled in the art. The encoder 82 would then transmit the information to the inverter 18 for tracking the speed of the main spindle shaft 20 and attached weaving blade. The inverter 18, then transmits the information back to the computer 14, so that any adjustments can be made.

Referring again to FIGS. 1, 5A and 5B, an actuation mechanism 84, such as a bar secured to known oscillating catch finger mechanisms, is provided for opening and closing the slot 66 in the trough 26. When the fence 30 is being woven, a trailing needle 24A already woven to the fence 30, is frictionally retained in the slot 66 while further intercoiled needles 24, 24A are being woven thereto in the trough 26. The elliptical shape of the trough, and the radius of the first portion 62 of the trough 26 prevents the starting hook 28 of leading needle 24 being woven, from catching in or extending into the slot 66, so as to prevent misweaves. After the weaving of a pair of needles 24, 24A is complete, the actuation mechanism 84 spreads the first ends 68, 70 of the portions 62, 64 to open the slot 66. The machine 10 is then indexed in a known manner so as to lift up or pull the trailing portion of the prior woven picket retained therein out of the slot 66, until the further just woven trailing needle 24A is positioned in the slot 66. The actuation mechanism 84 then closes the slot 66 to frictionally engage this just woven trailing needle 24A, so the next two intercoiled needles 24, 24A (picket) can be woven thereto.

Thus, there has been described an improved and simplified system for controlling a chain link fence weaving machine. The control system controls the motor's speed for controlling the rate that the two needles or picket to be woven are fed into the trough to determine the fabrication rate of chain link fence being woven. The control system and electronic motor eliminate the need for prior art clutch-brake systems for stopping and starting the blade and for indexing the machine. The speed of the motor is variable so as to drive the weaving blade up to a maximum of approximately 1200 RPM, so that an optimum production rate, twice the output rate of prior art machines, can be achieved. The configuration of the weaving trough prevents the starting hook of the leading intercoiled needle being woven in the trough from catching in or extending into the slot. Thus, fence can be woven by the weaving machine at a substantially increased rate, without misweaves during the fabrication process.

Those skilled in the art will appreciate that various adaptations and modification of the just-described preferred embodiments can be configured without departing from the scope and spirit of the invention. Therefore, it is to be understood that, within the scope of the appended claims, the invention may be practiced other than as specifically described herein.

What is claimed is:

1. A chain link fence weaving system comprising:

an electronic motor coupled to a main spindle shaft and an attached weaving blade of a chain link fence weaving machine for driving said main spindle shaft and attached weaving blade;

an electronic control means for controlling said electronic motor, said control means coupled to said electronic motor and to said chain link fence weaving machine for controlling a fabrication rate of chain link fence being woven, said electronic control means controlling the height and length of said chain link fence;

means for continuously feeding two strands of wire from two coils of wire onto said weaving blade, so as to form two intercoiled needles at a time; and trough means located adjacent to said weaving blade and coupled to said chain link fence weaving machine, said trough means receiving said two intercoiled needles from said weaving blade for weaving said chain link fence, said trough means comprising an elongated trough having first and second portions with a retaining means therebetween, said trough means having a configuration which prevents said two intercoiled needles being woven in said trough from extending into said retaining means, said trough means further including means for frictionally retaining a first picket of the formed chain link fence in said retaining means while said two intercoiled needles are woven to said first picket for further fabricating said chain link fence.

2. The system of claim 1 wherein said first and second portions of said trough means are substantially arcuate with the radius of the first portion less than the radius of the second portion for preventing said two intercoiled needles being woven in said trough means from extending into said retaining means, said first portion having an upwardly projecting flange at a first end thereof that extends substantially parallel to a first end of said second portion, said trough means including biased hinge means affixed to said first and second portions adjacent to a second end of each of said first and second portions for coupling said first and second portions together and for biasing said flange against the first end of the second portion, said biased hinge means closing said retaining means to frictionally engage said first picket, and actuation means coupled to said trough means for opening said retaining means to release said first picket from said retaining means and for closing said retaining means to frictionally engage a second picket therein.

3. The system of claim 1 wherein said control means comprises:

an input means for entering desired data;

computing means coupled to said input means for processing data received from said input means; and inverter means coupled to said computing means and to said electronic motor, said inverter means receiving a signal from said computing means, said inverter means transmitting a signal to said electronic motor for controlling the speed of said main spindle shaft and said attached weaving blade to control the input rate of said two intercoiled needles being woven in said trough means for controlling the output rate of said chain link fence weaving machine responsive to signals received from said computing means, said inverter means further transmitting signals to said chain link fence weaving machine for controlling height, length, and diamond dimensions of chain link fence being woven responsive to signals received.

4. The system of claim 3, further including a remote terminal coupled to said inverter means for controlling said chain link fence weaving machine.

5. The system of claim 3 wherein said input means includes means for controlling an amount of diamonds formed in a picket when said chain link fence is woven for determining the height of fence to be fabricated.

6. The system of claim 3 wherein said input means includes means for counting the number of pickets which are woven for controlling the length of fence fabricated.

7. The system of claim 3 wherein said input means includes means for counting a total number of rolls of fence fabricated.

8. The chain link fence weaving system of claim 1 wherein said trough means is elliptical in shape.

9. An improved system for operating a chain link fence weaving machine, said system comprising:

an electronic motor coupled to a main spindle shaft of said machine for driving a weaving blade attached to said main spindle shaft;

means for continuously feeding two strands of wire from two coils of wire onto said weaving blade, so as to form two intercoiled needles at a time;

trough means disposed adjacent to said weaving blade and coupled to said chain link fence weaving machine, said trough means receiving said two intercoiled needles from said weaving blade for weaving said chain link fence in said trough means, said trough means comprising an elongated trough having first and second opposing portions configured to receive said two intercoiled needles therebetween with a slot extending between the first and second portions, said trough means having an elliptical configuration which prevents said intercoiled needles being woven therein from extending into said slot, said trough means further including actuation means for opening and closing said slot, said actuation means closing said slot to frictionally engage a portion of woven fence comprising a first picket therein while said two intercoiled needles are woven into said first picket in said trough means to form said chain link fence, said actuation means opening said slot to disengage said first picket from said slot, and to receive a second picket woven to said chain link fence being formed in said slot, prior to closing said slot; and an electronic control means for controlling said chain link fence weaving machine, said control means coupled to said electronic motor for controlling the fabrication rate of chain link fence being woven, said control means further controlling height and length of said chain link fence being woven.

10. The system of claim 9 wherein said trough means comprises first and second portions and said first and second portions are substantially arcuate with the radius of the first portion less than the radius of the second portion for preventing said two intercoiled needles being woven in said trough from extending into said slot, said first portion having an upwardly projecting flange at a first end thereof that extends substantially parallel to a first end of said second portion for retaining said first picket substantially parallel to said trough means, said trough means including biased hinge means affixed to said first and second portions adjacent to a second end of each of said first and second portions for coupling said first and second portions together and for biasing said upwardly projecting flange against said first end of said second portion.

11. The system of claim 9 wherein said control means further comprises:

input means for entering desired data;

computing means coupled to said input means for processing data received from said input means; and inverter means coupled to said computing means and to said electronic motor, said inverter means receiving a signal from said computing means, said inverter means transmitting a signal to said electronic motor for controlling the speed of said weaving blade to control the input rate of said two intercoiled needles being woven in said trough for controlling the output rate of said chain link fence weaving machine responsive to signals received from said computing means, said inverter means further transmitting signals to said chain link fence weaving machine for controlling height, length, and picket dimensions of chain link fence being woven responsive to signals received.

12. The system of claim 11, further including a remote terminal coupled to said inverter means for controlling said inverter means.

13. An improved trough means for use in weaving chain link fence in a chain link fence weaving machine, said trough means comprising:

an elongated body having a slot therein;

said elongated body having a configuration which prevents intercoiled needles being woven therein from entering said slot;

said elongated body having two portions with hinged biasing means, located away from said slot, connecting said two portions together; and actuating means for opening and closing said slot.

14. The improved trough means of claim 13 wherein said two portions are arcuate and positioned to receive said two intercoiled needles being woven therebetween, a first of said two portions having a radius less than the radius of the second of said two portions for preventing said two intercoiled needles being woven in said trough means from extending into said slot.

15. The improved trough means of claim 14, further including an upwardly projecting flange formed at a first end of said first of said two portions and which extends adjacent to a first end of said second of said two portions and said upwardly extending flange; and said actuation means for opening and closing said slot comprising a mechanical arm connected between said trough and said chain link fence weaving machine.

16. The improved trough means of claim 15, further including a biased hinge means affixed to the first and second portions adjacent to a second end of each of said first and second portions for coupling said first and second portions together and for biasing said upwardly projecting flange against said first end of said second portion.

17. The improved trough means of claim 13 wherein said trough is elliptical in cross section and said two portions are arcuate and positioned to receive said two intercoiled needles being woven therebetween, said two portions having radii which are different from each other to prevent said two intercoiled needles being woven in the elliptical trough from extending into said slot.

18. The improved trough means of claim 17, further including an upwardly projecting flange formed at a first end of a first of said two portions and which extends adjacent to a first end of said second of said two portions and said upwardly extending flange; and said actuation means for opening and closing said slot comprising a mechanical arm connected between said trough and said chain link fence weaving machine.

19. The improved trough means of claim 17, further including a biased hinge means affixed to the first and second portions adjacent to a second end of each of said first and second portions for coupling said first and second portions together and for biasing said upwardly projecting flange against said first end of said second portion.

20. The improved trough means of claim 13 wherein said trough means is elliptical in shape.

* * * * *